US009257228B2

(12) United States Patent
Anderson et al.

(10) Patent No.: US 9,257,228 B2
(45) Date of Patent: Feb. 9, 2016

(54) METHOD OF MANUFACTURING A TRANSFORMER CORE ASSEMBLY

(76) Inventors: Scott Anderson, Raleigh, NC (US); Sandina Ponte, Columbia, MO (US)

( * ) Notice: Subject to any disclaimer, the term of this patent is extended or adjusted under 35 U.S.C. 154(b) by 692 days.

(21) Appl. No.: 12/795,919

(22) Filed: Jun. 8, 2010
(Under 37 CFR 1.47)

(65) Prior Publication Data

US 2011/0072643 A1 Mar. 31, 2011

Related U.S. Application Data

(60) Provisional application No. 61/186,189, filed on Jun. 11, 2009.

(51) Int. Cl.

| | |
|---|---|
| ***H01F 41/02*** | (2006.01) |
| ***H01F 3/02*** | (2006.01) |
| ***H01F 3/00*** | (2006.01) |
| *H01F 3/04* | (2006.01) |

(52) U.S. Cl.
CPC ..... *H01F 41/0213* (2013.01); *H01F 3/00* (2013.01); *H01F 3/02* (2013.01); *H01F 41/0206* (2013.01); *H01F 41/0233* (2013.01); *H01F 3/04* (2013.01); *Y10T 29/4902* (2015.01); *Y10T 29/49075* (2015.01); *Y10T 29/49078* (2015.01); *Y10T 29/53165* (2015.01); *Y10T 29/53261* (2015.01); *Y10T 29/53265* (2015.01)

(58) Field of Classification Search
CPC ..... H01F 41/0206; H01F 41/0213; H01F 41/0233; H01F 3/00; H01F 3/02; H01F 3/04; Y10T 29/4902; Y10T 29/49075; Y10T 29/49078; Y10T 29/53165; Y10T 29/53261; Y10T 29/53265
USPC ..... 29/602.1, 607, 609, 737, 759, 760, 742, 29/711; 336/232, 234
See application file for complete search history.

(56) References Cited

U.S. PATENT DOCUMENTS

| | | | | |
|---|---|---|---|---|
| 3,955,264 A * | 5/1976 | Klappert | ..... | 29/609 X |
| 5,261,152 A * | 11/1993 | Simozaki et al. | ..... | 29/609 |
| 2008/0229799 A1 * | 9/2008 | Musat et al. | ..... | 29/602.1 X |

FOREIGN PATENT DOCUMENTS

| | | | | |
|---|---|---|---|---|
| JP | 01233715 A * | 9/1989 | ..... | 29/602.1 |

* cited by examiner

*Primary Examiner* — A. Dexter Tugbang
(74) *Attorney, Agent, or Firm* — Taft Stettinius & Hollister, LLP

(57) ABSTRACT

A method is provided for making a transformer core assembly using a work table positioned proximate to a rotatable rack assembly having first and second racks. Core segments are created by a segment forming machine. The core segments are transferred to a core block of the second rack. After a predetermined number of core segments are stacked on the core block to form a core segment assembly, the rack assembly is rotated so that the second rack is positioned proximate to the work table. The second rack is then moved onto the work table and one or more finishing steps are performed on the core segment assembly. During the performance of the one or more finishing steps, core segments may be transferred to a core block attached to the first rack.

5 Claims, 9 Drawing Sheets

METHOD OF MANUFACTURING A TRANSFORMER CORE ASSEMBLY

CROSS REFERENCE TO RELATED APPLICATION

This application claims the priority of U.S. provisional patent application Ser. No. 61/186,189 filed on Jun. 11, 2009 entitled "Transformer Core Assembly Apparatus," the contents of which are relied upon and incorporated herein by reference in their entirety, and the benefit of priority under 35 U.S.C. 119(e) is hereby claimed

BACKGROUND

Wound-core style transformer cores are commonly manufactured by building up the core with a plurality of layered core segments. The process generally includes a machine that continuously produces core segments from relatively thin metallic strips. The process requires an operator to stand in front of the machine, wait (typically 1-5 seconds) for a steel laminate to feed out of the machine, then place it on a table in concentric loops. When a sufficient number of core segments are layered, the segment forming machine is stopped, and a number of finishing steps are performed on the core assembly. Once the finishing steps are completed, the core assembly is sent on for further processing (e.g. annealing) and the core assembly process begins again. This method of assembly is inefficient, monotonous and time consuming.

There is therefore a need in the art for a transformer core assembly process having greater efficiency and speed without the need for additional human operators.

SUMMARY OF THE INVENTION

According to one aspect of the present invention, a method is disclosed for producing a transformer core assembly in a production facility including a work table and a rotatable rack assembly having a first rack initially positioned adjacent to the work table and a second rack initially positioned on the opposed side of the rotatable rack assembly from the first rack, the racks having a core block attached thereto. The method includes, creating a plurality of core segments and transferring each of said plurality of core segments to the core block attached to the second rack. The plurality of core segments form a core segment assembly. After a predetermined number of core segments are stacked on the core block, rotatable rack assembly is rotated so that the second rack is positioned adjacent to the work table. The second rack is then moved to the work table. Once moved to the work table finishing steps are performed on the core segment assembly. While the finishing steps are being performed, core segments are transferred to the core block attached to the first rack.

According to another aspect of the present invention, a system is disclosed for making transformer core assemblies from core segments output from a segment forming machine. The system includes a rack assembly including a platform and a first rack and a second rack. The racks are positioned on opposing sides of the platform and each rack carries a core block. A transfer mechanism has a rail extending between the segment forming machine and the rack assembly. A body portion is movable along the rail, and couples to a core segment after it is output from the segment forming machine. A work table is positioned adjacent to the rack assembly. The platform is rotatable between a first platform position wherein the first rack is located adjacent to the work table and the second rack is located outwardly of the work table and a second platform position wherein the second rack is located adjacent to the work table and the first rack is located outwardly of the work table. The body portion is positionable over the rack located outwardly of the work table.

BRIEF DESCRIPTION OF THE DRAWING FIGURES

DETAILED DESCRIPTION OF THE INVENTION

Figure 1:
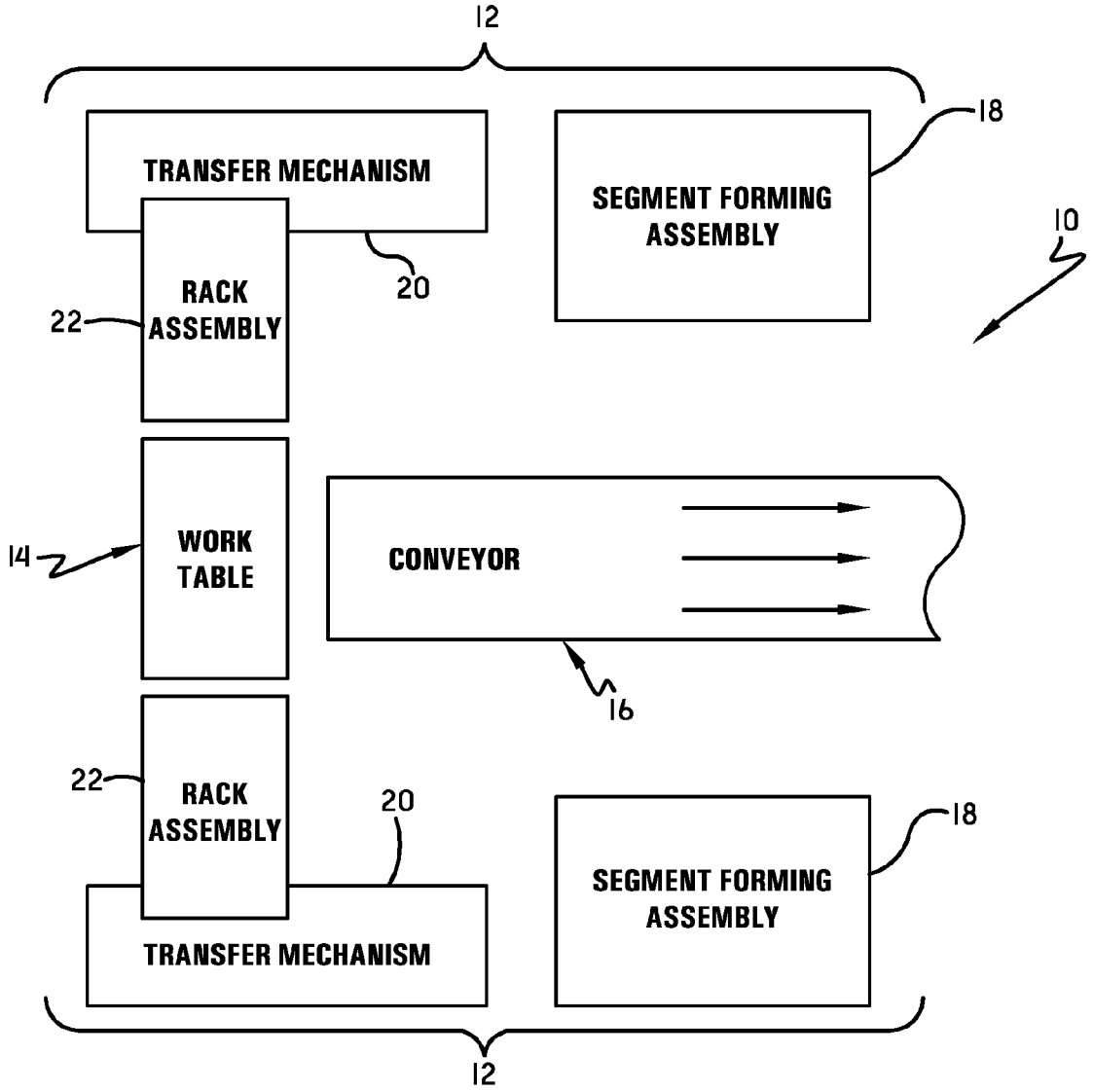
FIG. 1 is an overhead simplified schematic of the transformer core assembly apparatus according to the present invention.

With reference to FIG. 1, a transformer core assembly apparatus according to the present invention is generally indicated by the numeral 10. The transformer core assembly apparatus 10 includes two core stacking sub-assemblies 12 positioned on opposed sides of a work table 14. As will be discussed in greater detail below, transformer core assemblies are continuously assembled in the transformer core assembly apparatus 10 and, once completed, placed on a conveyor 16 for further processing. Additional processing may include, for example, annealing and incorporation into a transformer assembly.

Figure 2:
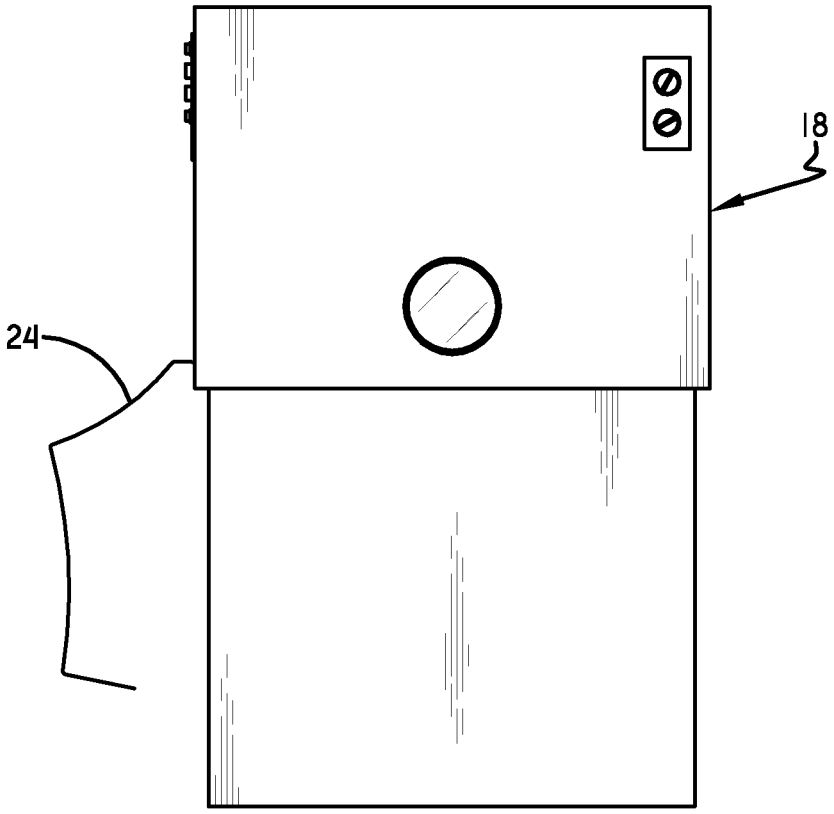
FIG. 2 is a side view of a core segment forming machine.

Each core stacking sub-assembly 12 includes a segment forming machine 18, a transfer mechanism 20 and a rack assembly 22. Segment forming machine 18 (see FIG. 2) is computer controlled, and receives material in the form of a continuous metal strip and forms individual core segments 24 therefrom. As is known in the art, the segment forming machine bends and cuts the input material into core segments 24 that are generally rectangular. The input material is typically a steal laminate. In one embodiment the input material is a silicone and steal laminate. The input material may range from 0.2-0.35 mm thick and 30-300 mm wide.

The core segments 24 are ultimately layered and banded to form transformer cores. As a transformer core is built up, the computer controlled segment forming machine will form a slightly larger rectangular shape with each new layer. Transformer cores may be many sizes. For example, the transformer core could be 8 inches thick and over 650 lbs. One exemplary segment forming machine is a Unicore machine made by AEM Cores PTY. LTD.

Figure 3:
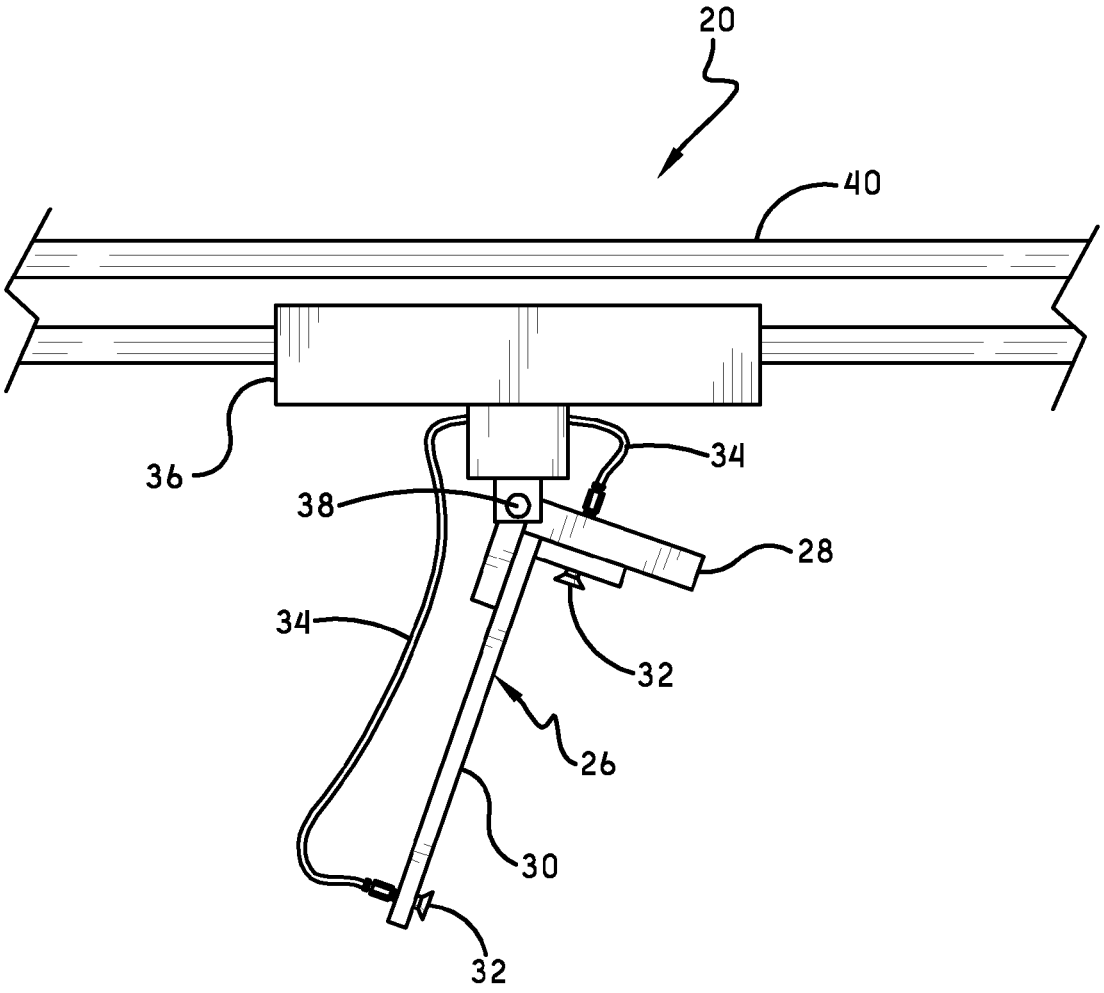
FIG. 3 is a side view of the transfer mechanism according to the present invention.

With reference now to FIG. 3, transfer mechanism 20 is provided to transfer each core segment 24 from the segment forming machine 18 to the associated rack assembly 22. Transfer mechanism 20 may include an L-shaped body section 26 having a relatively shorter leg 28 and a relatively longer leg 30. Both legs 26 and 28 may be adjustable to accommodate different core sizes. A suction device 32 is provided on each leg 28 and 30 to selectively adhere to the core segments 20. Accordingly, each suction device 32 may be fed by a hose 34 that selectively draws air in (when carrying a core segment) or blows air outwardly (when it is desired to drop the core segment). It should be appreciated that other methods of selectively capturing the core segments may be used, for example, magnetic attraction, mechanical gripping, or the like.

Proximate to the intersection of short and long leg 28 and 30, L-shaped body 26 is pivotally secured to a carrier 36. Carrier 36 may selectively rotate L-shaped body 26 about a pivot point 38 in order to more readily facilitate the capture and release of core segments 24. Rotation of L-shaped body 26 might be accomplished using a ball screw. Carrier 36 is carried on rails 40 that extend between segment forming machine 18 and rack assembly 22. Any means may be used to move carrier 36 on rails 40, for example, carrier 36 may be belt or motor driven or may be driven by a linear actuator or pneumatic piston.

Figure 5:
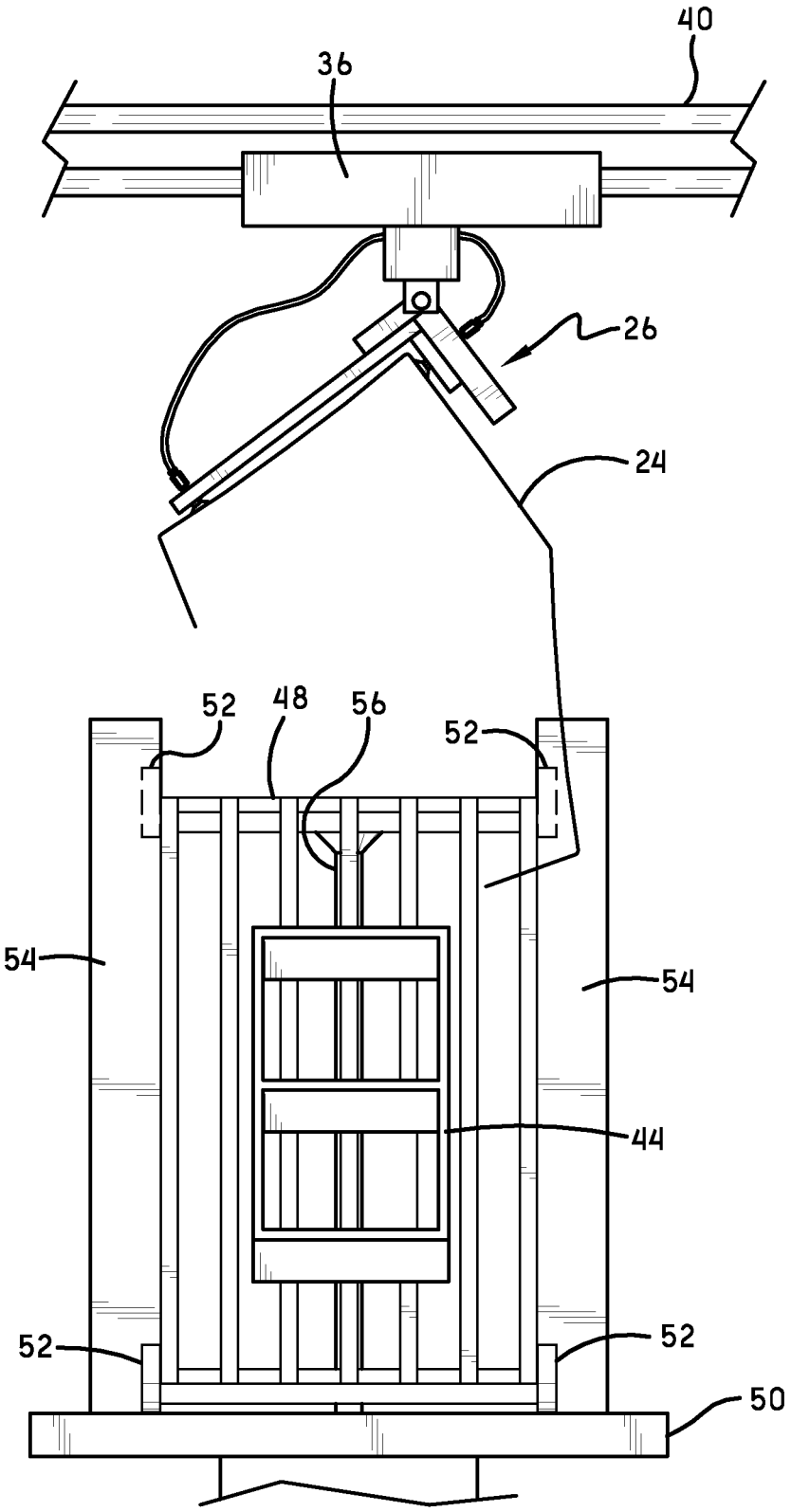
FIG. 5 is a side view of the transfer mechanism positioning the core segment over a core block carried by the rack assembly.
Figure 7:
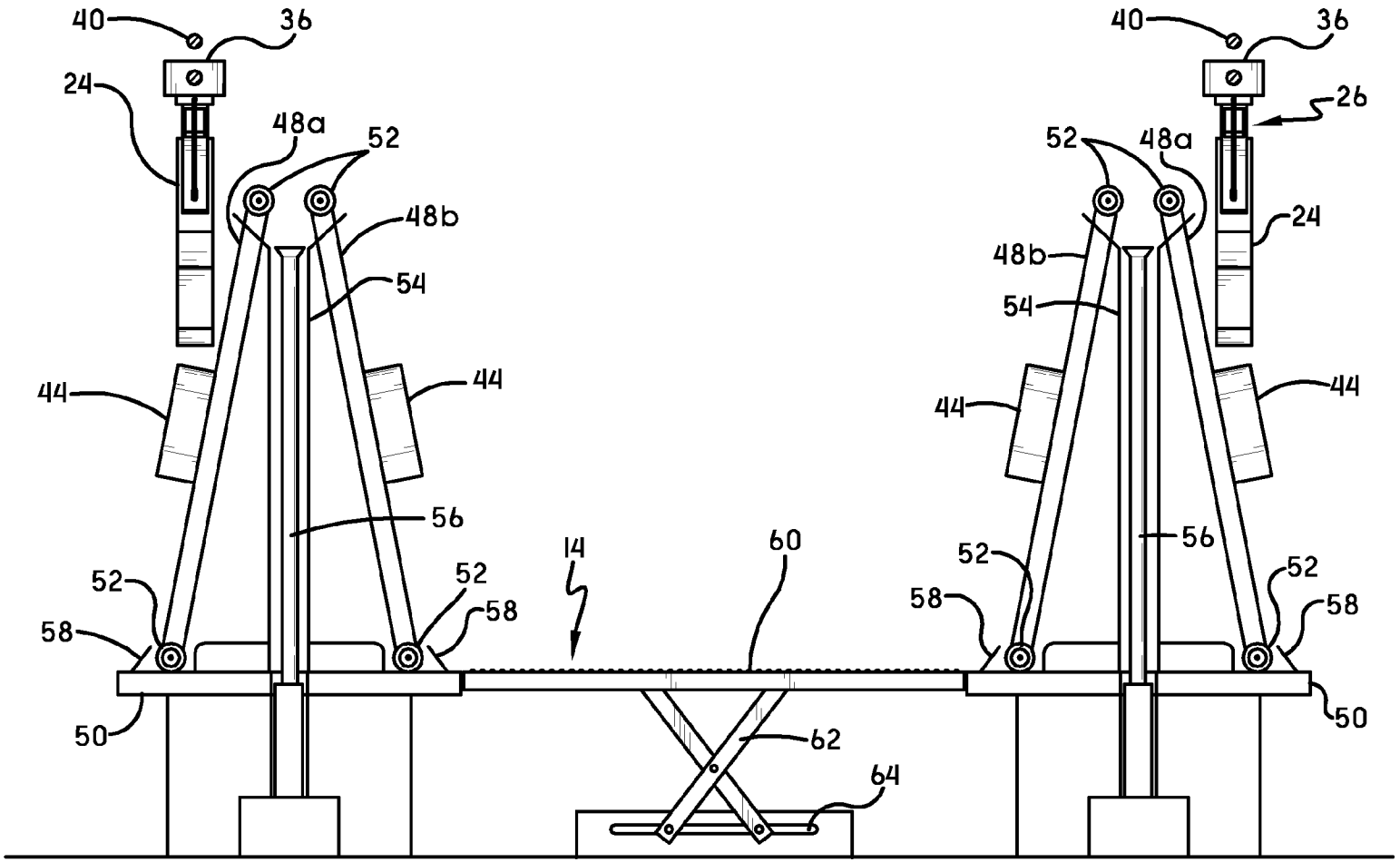
FIG. 7 is a rear view of the rack assemblies with racks in the upright, locked orientation and the center work table in the elevated position.

With reference to FIGS. 5 and 7, each rack assembly 22 includes a pair of opposed racks 48*a* and 48*b* that are carried on a pedestal 50. Racks 48 may include wheels 52 at opposed ends. Wheels 52 at the top end of racks 48 are carried in a vertical support 54 in a manner that allows wheels 52 to move upwardly and downwardly therein. Wheels 52 at the bottom end of racks 48 are supported on the top surface of pedestal 50. A linear actuator 56 is positioned centrally in pedestal 50 and selectively engages the top end of racks 48.

Figure 9:
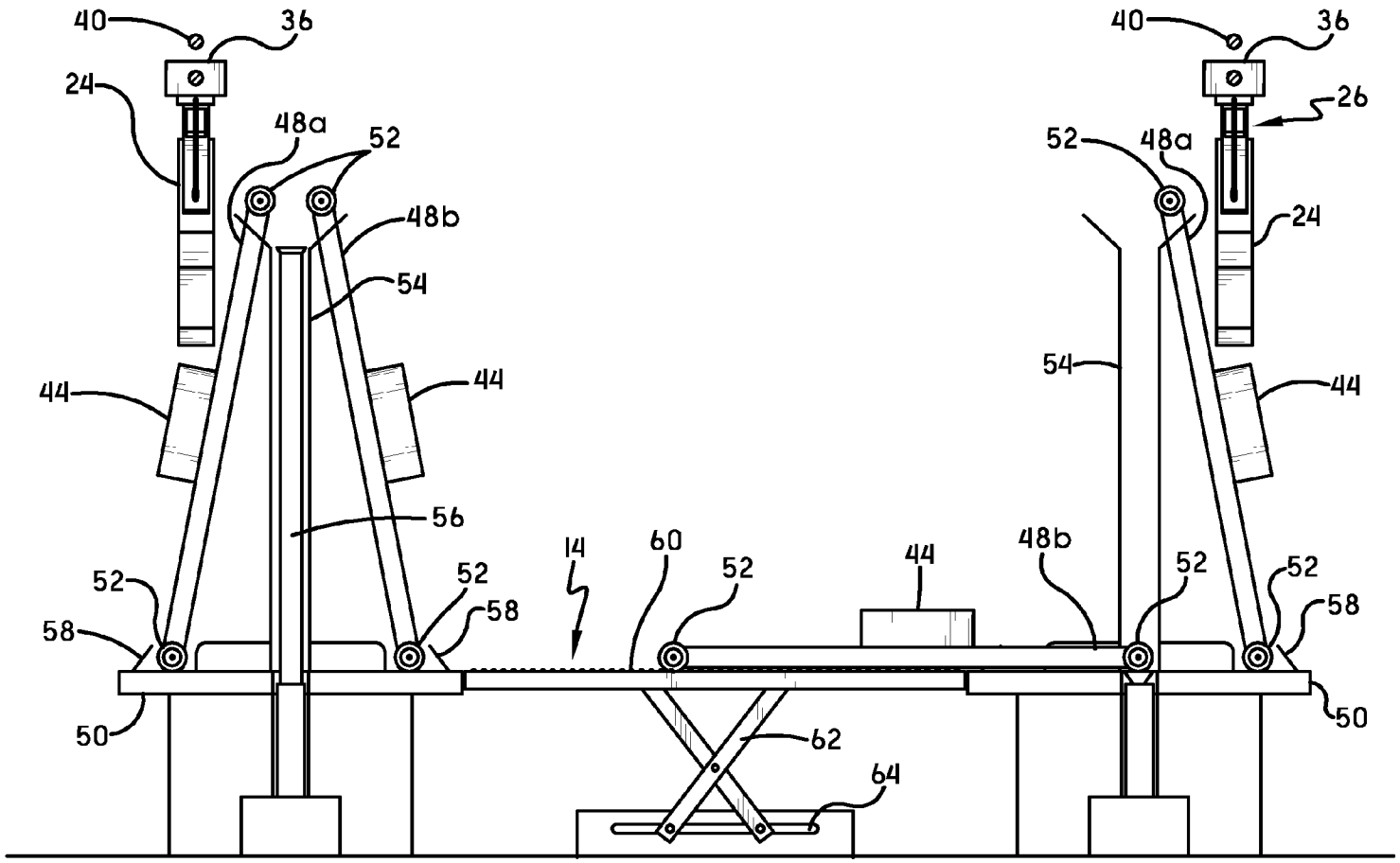
FIG. 9 is a rear view of the rack assemblies with one rack in the lowered, finishing orientation.

Racks 48 are movable between a generally upright, locked position (shown in FIGS. 5 and 7) and a generally horizontal position (shown in FIG. 9). Racks 48 are raised and lowered using the linear actuator 54 and may be held in the upright, locked position using a locking tab 58. Pedestals 50 are rotatable so that either rack 48*a* or 48*b* may be selectively positioned proximate the work table 14. Work table 14 includes a top surface 60 that may include a plurality of upwardly extending bearings. In one or more embodiments, the bearings may be positioned on the work table 14 such that, when racks 48 are positioned horizontally across work table 14, the bearings extend upwardly through the spaces between the vertical linkages of the racks 48. Thus, when the racks 48 are laid horizontally, the bearings may take up the weight of the assembled core segments.

Work table 14 is positioned so that the top surface 60 is generally co-planar with the top surface of pedestal 50. However, as will be discussed in greater detail below, work table 14 may be selectively lowered and raised. Thus, work table 14 may include a pair of legs 62 secured at the top proximate to the work table surface 60 and at the bottom in a channel 64. The legs 62 may move along channel 64 to cause the surface 60 to move upwardly and downwardly.

Figure 4:
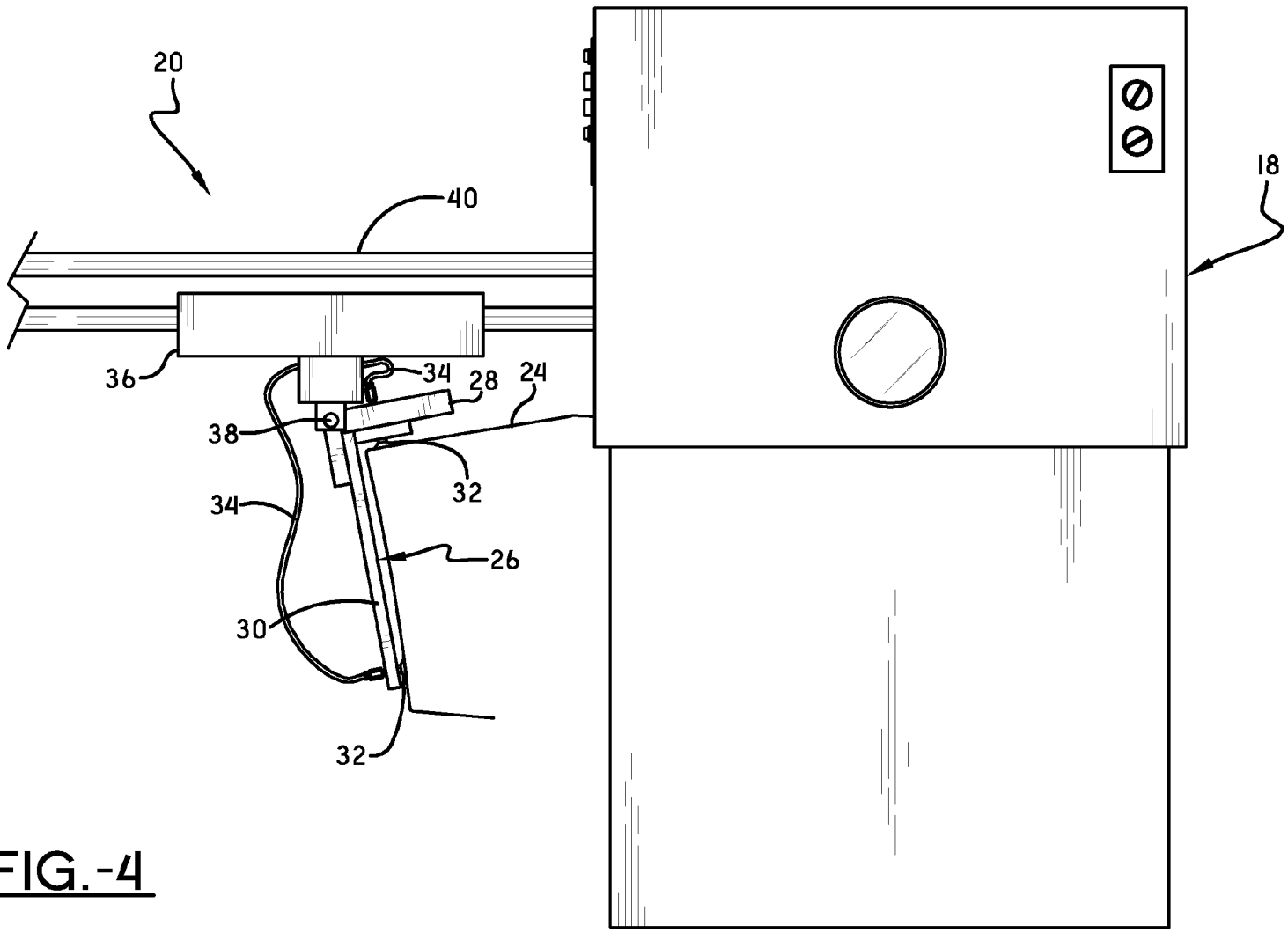
FIG. 4 is a side view of the transfer mechanism grasping a core segment as it exits the core segment forming machine.

With reference now to FIG. 4, the operation of transformer core assembly machine 10 will now be discussed. In a first step, the core segment forming machine 18 initiates and begins producing individual core segments 24. In a second step, as the core segments 24 are output from core segment forming machine 18 they are initially captured by transfer mechanism 20. In a third step, when the segment 24 is complete and exits segment forming machine 18, the carrier 36 moves along rails 40 to a position generally above a core block 44 positioned on rack assembly 22 (see FIGS. 5 and 7). Core block 44 is not a final element of the core, but is provided to support the core segments 24 during assembly. Core block 44 may also remain attached to the core segment assembly during later processes, such as annealing, etc.

Figure 6:
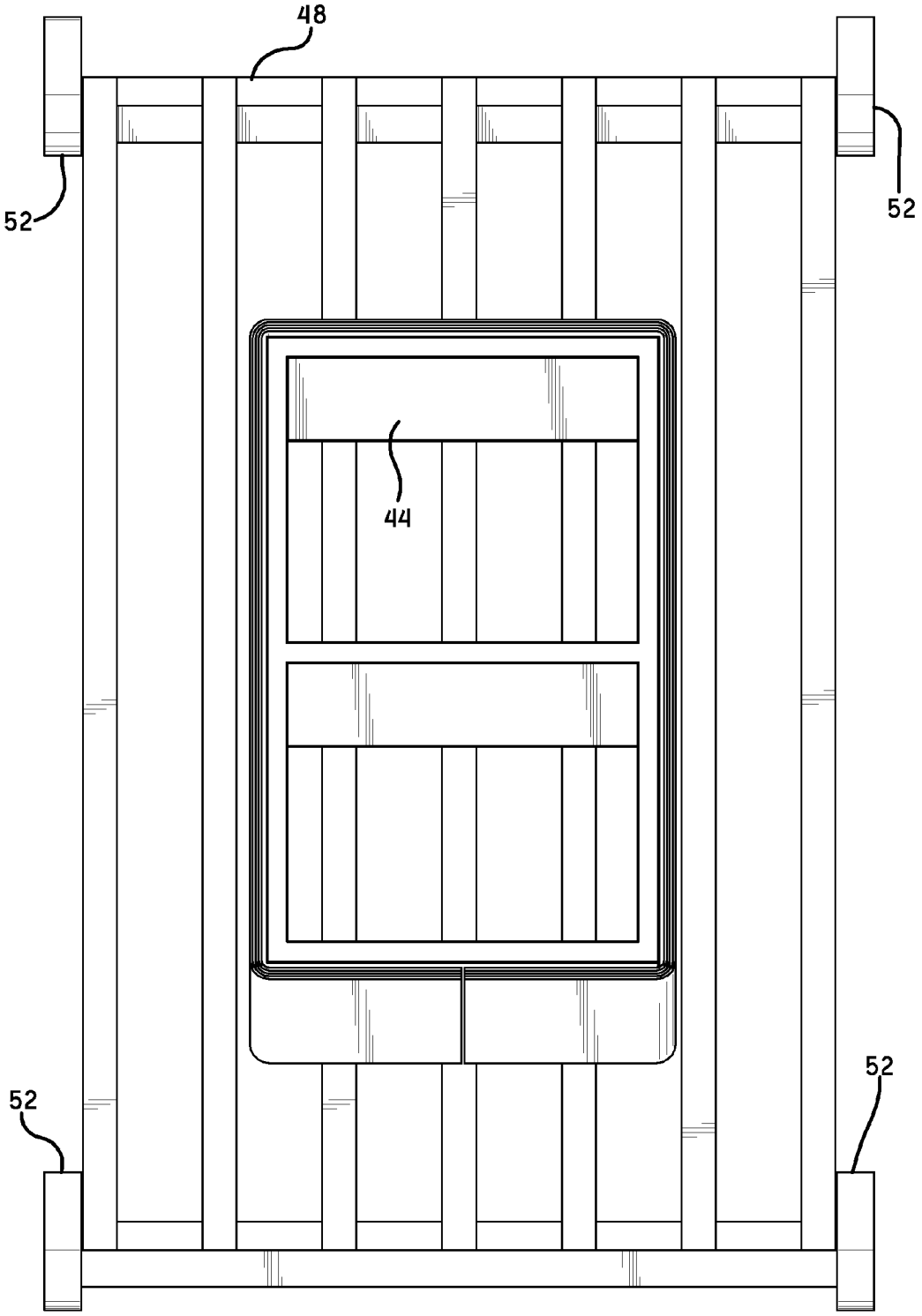
FIG. 6 is an enlarged view of the core block, rack and plural layers of core segments.

In a fourth step, the core segment 24 is released by transfer mechanism 20 and falls onto core block 44. As can be seen in FIG. 7, the transfer mechanism 20 drops the core segment 24 on the outward facing rack 48*a* (relative to the centrally positioned work table). In a fifth step, the carrier 36 returns to segment forming machine 18 and retrieves the next core segment. This process is repeated until a predetermined number (or weight) of core segments are layered onto core block 44 (see FIG. 6). The rack 48*a* may be fitted with a scale to determine core weight and hence be able to re-calculate the number of sheets needed to make the core. Hereinafter, the layered core segments, once the appropriate number are stacked, are referred to as a core segment assembly.

Figure 8:
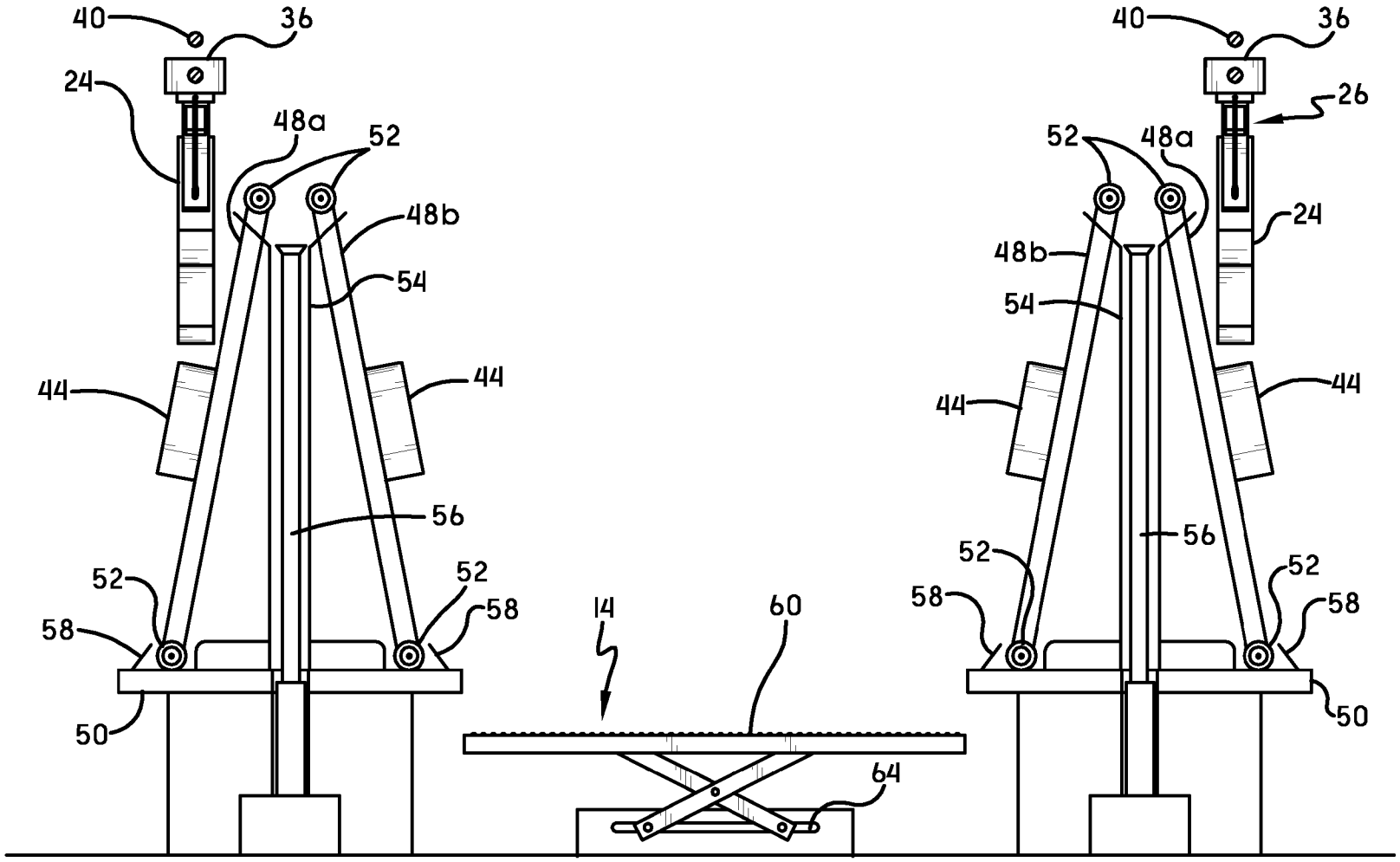
FIG. 8 is a rear view of the rack assemblies with racks in the upright, locked orientation and the center work table in the lowered position.

With reference now to FIG. 8, when the appropriate number of core segments 24 are positioned on core block 44, in a sixth step, the segment forming machine 18 halts creation of core segments. In a seventh step, the work table 14 lowers to avoid contacting pedestal 50 during rotation. In an eighth step, the pedestal 50 rotates 180 degrees so that the rack 48 carrying the core segment assembly is positioned proximate to the work table 14 (i.e. inwardly facing, toward the centrally positioned work table). Once rotation of pedestal 50 is complete, segment forming machine 18 again begins producing core segments 24, which are transferred to the now empty core block 44 on the rack 48*a* facing away from the work table 14.

In a ninth step, once rotation of pedestal 50 is complete, the work table 14 may be raised back to a position generally parallel with pedestal 50. In a tenth step, the rack 48*b* proximate to the work table 14 may be lowered onto the work table 14 by releasing the locking tab 58 and lowering the linear actuator 56. As discussed above, rack 14 may include bearings or other low friction feature that extend upwardly from the rack surface, through the rack 48*b*, to engage the core segment assembly. When in the horizontal position, in an eleventh step, one or more finishing steps are performed by the human operator. The main finishing operations may include: (1) removing the core block 44 from inside the stacked core segments 24, (2) arranging gaps in the core segments 24, (3) placing the core block 44 back inside the core segments 24 and banding (fastening a steel band around the outside of the core segments 24), and (4) labeling the core. In a final step, the banded core assembly may be moved onto the conveyor 16. Once the banded core is moved onto the conveyor 16, a new core block 44 may be placed on the rack 48*b* and it may be moved by the linear actuator 56 back into the upright, locked position.

As should be readily apparent, both core stacking assemblies 12 may advantageously operate simultaneously. Thus, the present invention enables two core segment assemblies to be built-up at the same time on the outward facing racks 48*a*. At the same time, finishing steps may be performed on one of the completed core segment assemblies located on the inwardly facing racks 48*b*. Thus, the present invention achieves increased process efficiency by (1) automating the stacking of the core segments; (2) enabling the human operator to perform finishing steps while another core segment assembly is built-up; and (3) increasing productivity by providing a second core-stacking sub-assembly. Thus, in the manner described above, the number of core segment assemblies produced by a single human operator is greatly increased.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

We claim:

1. A method of producing a transformer core assembly in a production facility including a work table and a rotatable rack assembly having a first rack initially positioned facing toward and proximate to the work table and a second rack initially positioned on the opposed side of the rotatable rack assembly from the first rack and facing away from the work table, the racks each having a core block attached thereto, the method comprising:

(a) creating a plurality of core segments;

(b) transferring said core segments to the core block attached to the second rack;

(c) after a predetermined number of core segments have been transferred to the core block attached to the second rack to thereby form a core segment assembly, rotating the rotatable rack assembly 180 degrees so that the second rack with the core segment assembly is positioned facing toward and proximate to the work table and the first rack is positioned facing away from the work table;

(d) moving the second rack onto the work table;

(e) performing one or more finishing steps on the core segment assembly while the second rack is on the work table; and (f) during the performing of the one or more finishing steps, transferring core segments to the core block attached to the first rack.

2. The method of claim 1 wherein said core segments comprise steel laminates.

3. The method of claim 1 wherein the rack assembly further includes a pedestal and a vertical support, the first and second racks each having one end positioned in the vertical support and an opposed end supported by the pedestal, and wherein the method further comprises:

lowering the work table relative to the pedestal before the step of rotating the rotatable rack assembly; and raising the work table to a position even with the pedestal after the step of rotating the rotatable rack assembly.

4. The method of claim 3 wherein said step of moving the second rack onto the work table comprises:

lowering the end of the second rack that is positioned in the vertical support so that the end of the second rack that is positioned on the pedestal moves onto the work table.

5. A method of producing a transformer core assembly in a production facility including a work table, a pedestal, a vertical support and a rotatable rack assembly having a first rack initially positioned facing toward and proximate to the work table and a second rack initially positioned on the opposed side of the rotatable rack assembly from the first rack and facing away from the work table, the racks each capable of receiving a core block attached thereto, and each having one end positioned in the vertical support and an opposed end supported by the pedestal, the method comprising:

(a) creating a plurality of core segments;

(b) transferring said core segments to the core block attached to the second rack;

(c) after a predetermined number of core segments have been transferred to the core block attached to the second rack to thereby form a core segment assembly, rotating the rotatable rack assembly after lowering the work table relative to the pedestal so that the second rack with the core segment assembly is positioned facing toward and proximate to the work table and the first rack is positioned facing away from the work table;

(d) raising the work table to a position even with the pedestal after the step of rotating the rotatable rack assembly (e) moving the second rack onto the work table;

(f) performing one or more finishing steps on the core segment assembly while the second rack is on the work table; and, (g) during the performing of the one or more finishing steps, transferring core segments to the core block attached to the first rack.

* * * * *